United States Patent [19]

Isham et al.

[11] Patent Number: 4,512,048

[45] Date of Patent: Apr. 23, 1985

[54] VAN SOFA BED

[76] Inventors: Robert O. Isham, Rte. 2, Box 135-B, Decatur, Tex. 76234; Wayne S. Reese, 7201 Hovenkamp Ave., Richland Hills, Tex. 76118

[21] Appl. No.: 517,684

[22] Filed: Jul. 27, 1983

[51] Int. Cl.[3] ..... A47C 17/04

[52] U.S. Cl. ..... 5/37 R; 5/48; 297/317; 297/65; 297/433

[58] Field of Search ..... 5/37 R, 37 B, 37 C, 5/41, 42, 47, 48, 118, 17, 12 R; 297/65, 317, 319, 342, 433, 436, 438

[56] References Cited

U.S. PATENT DOCUMENTS

| | | | |
|---|---|---|---|
| 3,140,114 | 7/1964 | Stephenson | 297/342 |
| 3,329,977 | 7/1967 | Heller | 5/37 R |
| 3,932,902 | 1/1976 | Belk | 297/65 |
| 4,037,872 | 7/1977 | Quakenbush | 297/65 |
| 4,131,960 | 1/1979 | Quakenbush | 5/37 R |

FOREIGN PATENT DOCUMENTS

| | | | |
|---|---|---|---|
| 192074 | 11/1956 | Austria | 5/37 C |
| 703109 | 1/1954 | United Kingdom | 5/37 C |

*Primary Examiner*—Gary L. Smith
*Assistant Examiner*—Michael F. Trettel
*Attorney, Agent, or Firm*—Charles D. Gunter, Jr.

[57] ABSTRACT

A sofa bed combination is shown of the type adapted to be mounted in the interior of an automotive van. The sofa bed includes a front cushion, a rear cushion and an intermediate cushion. The sofa bed cushions are pivotally mounted on a rigid frame which is affixed to the van interior. The linkage means allows the intermediate cushion to be pivoted between an upright position which forms a seat back with respect to the front cushion and a folded down position which is in the same horizontal plane as the front and rear cushions to form a bed.

5 Claims, 7 Drawing Figures

Fig.4
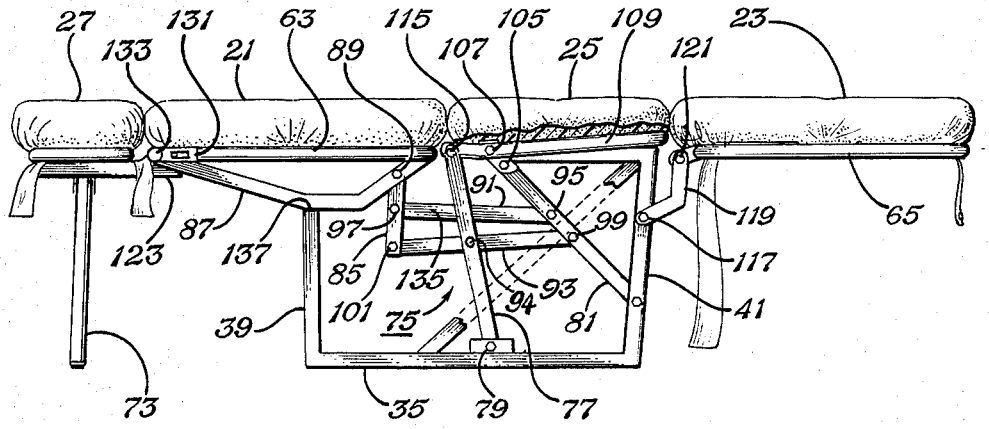
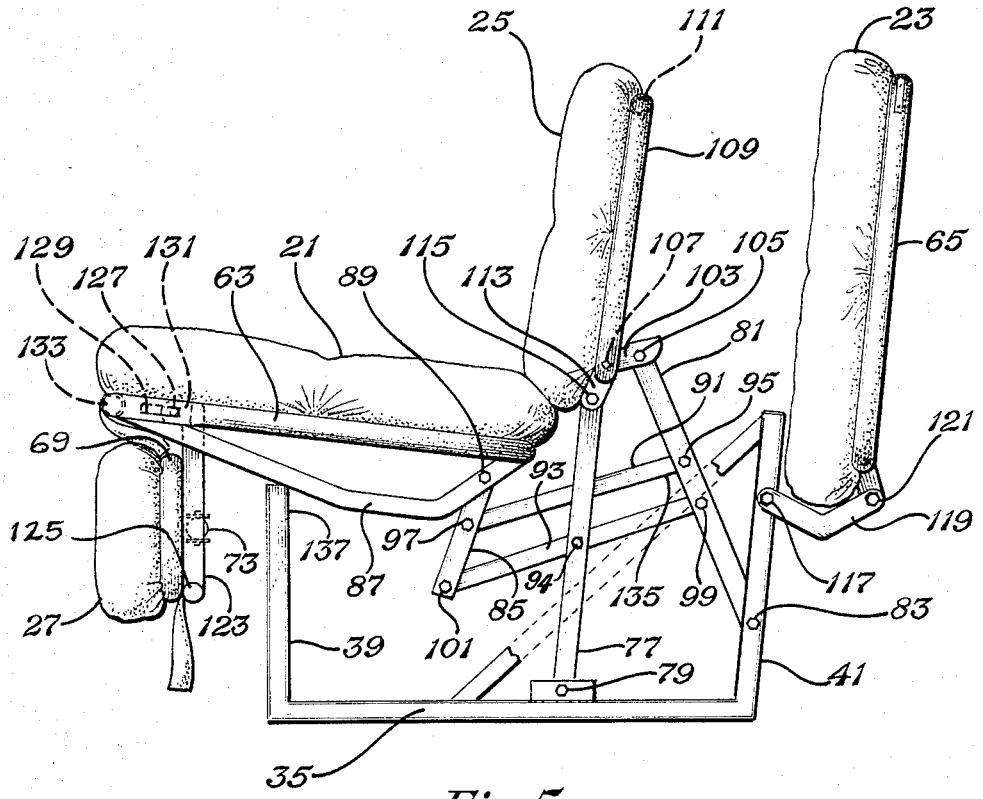
Fig.5

VAN SOFA BED

BACKGROUND OF THE INVENTION

The present invention relates to automotive van interior furnishings and specifically to a folding sofa bed adapted to be mounted in the interior of a van.

In recent years, customizing of automotive vans has become increasingly popular. Speciality shops now exist which are in the business of designing and installing interior furnishings for vans. Such furnishings include carpet, window blinds and trimmings, chairs and beds, as well as stereo and television equipment.

Although various reclining easy chairs and foldout bed designs are known for household use, there has existed a need for a foldout sofa bed of the type adapted to be mounted in the interior of a van. There has existed a need for such a sofabed design which would be foldable between an upright position which would form a seat for occupants within the van and a folded down position which would serve as a bed.

SUMMARY OF THE INVENTION

The present invention is a sofa bed which is adapted to be bolted into place within the interior of a van between the van sidewalls. The sofa bed combination includes a front cushion, a rear cushion, and an intermediate cushion. The sofa bed has a rigid frame and linkage means for pivotally mounting the cushions on the rigid frame. The intermediate cushion is pivotable between an upright position which forms a seat back with respect to the front cushion and a folded down position. The folded down position of the intermediate cushion is in the same horizontal plane with the front and rear cushions to form a bed.

The rigid frame is sized to fit within the interior of the van whereby the front and intermediate cushions form a rear seat for the van when the intermediate cushion is in the upright position. The front, intermediate and rear cushions are each supported on a cushion frame. The front, intermediate and rear cushions form a three-section bed when the intermediate cushion is in the folded down position.

The rigid frame has a pair of spaced-apart bottom rails, each of the bottom rails having front and rear side rails extending upwardly from the respective ends thereof. The front side-rails are connected by a front-cross rail and the rear side-rail are connected by a rear cross-rail. The spaced-apart bottom rails have matching link mechanisms mounted thereon for pivoting the cushions. Each of the link mechanisms includes a pivoting bar attached in the mid region of one of the bottom rails, a first scissor arm connected to a rear side-rail, and a second scissor arm connected to the front cushion frame. Top and bottom connecting bars pivotally connect the scissor arms. The first scissor arm on each side of the frame is pivotally connected at the end opposite the connection to the rear side-rail to the intermediate cushion frame. A selected one of the connecting bars on each side of the frame is pivotally connected to the adjacent pivoting bar.

Additional objects, features and advantages will be apparent in the written description which follows.

BRIEF DESCRIPTION OF THE DRAWINGS

FIG. 4 is a side view of the link mechanism of the sofa bed with portions of the bed broken away.

FIG. 5 is a side view of the link mechanism similar to FIG. 4 with portions of the bed broken away showing the intermediate cushion in the upright position.

DETAILED DESCRIPTION OF THE INVENTION

Figure 1:
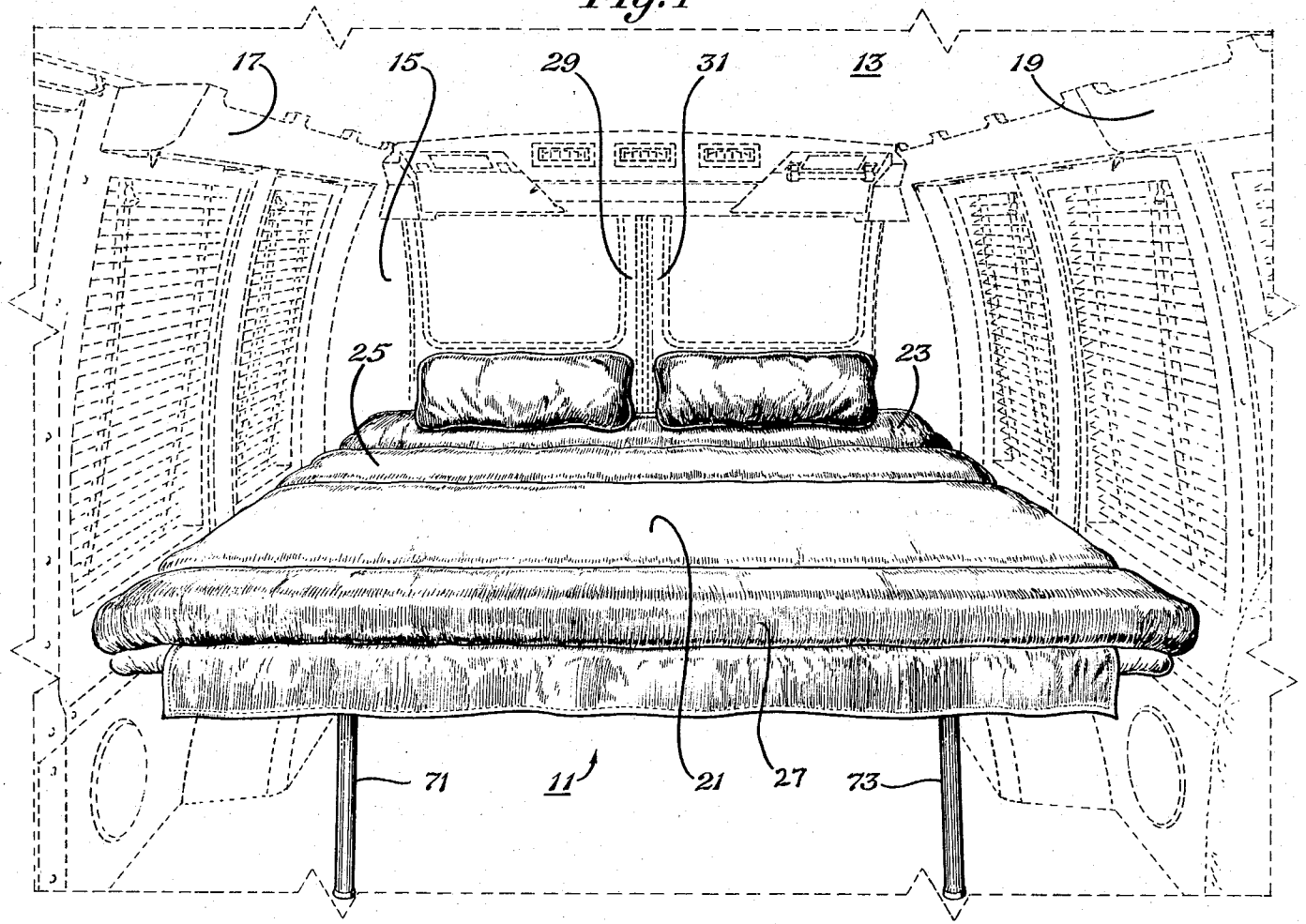
FIG. 1 is a perspective view of the sofa bed of the invention in the folded down position within a van interior with the van interior shown in dotted lines.

FIG. 1 shows a sofa bed of the present invention designated generally as 11, mounted within the interior 13 of an automotive van. As shown in FIG. 1, the sofa bed 11 is adapted to be mounted in the rear section 15 of the van between the sidewalls 17, 19 thereof. The sofa bed 11 has a front cushion 21, a rear cushion 23 and an intermediate cushion 25. A folding foot section 27 can also be included. In the preferred arrangement shown in FIG. 1, the longitudinal axis of each of the cushions 21, 23, 25 is arranged transverse to the plane of the van sidewalls 17, 19 and the rear cushion 23 is located proximate the van rear doors 29, 31.

Figure 2:
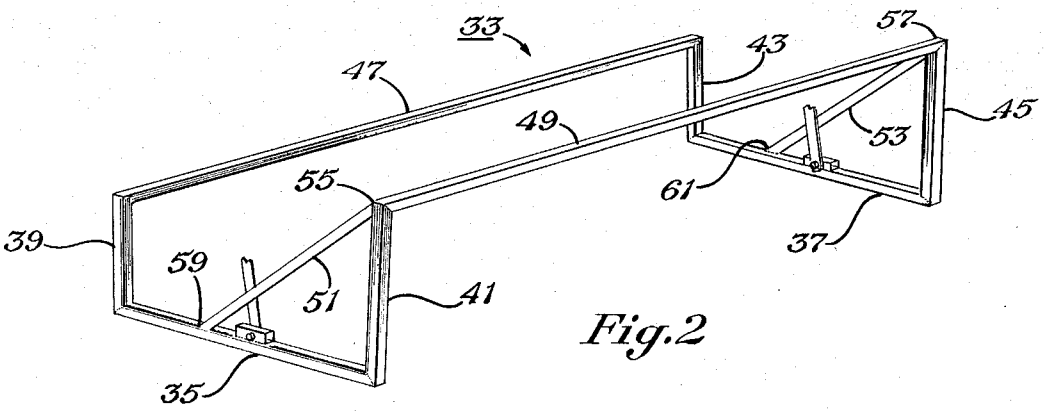
FIG. 2 is an isolated view of the rigid frame of the sofa bed of FIG. 1.

The cushions 21, 23, 25 are mounted on a rigid frame, designated generally as 33 in FIG. 2. The frame 33 has a pair of spaced-apart bottom rails 35, 37 which can be bolted to the van floor during installation. Each of the bottom rails 35, 37 has front and rear side-rails 39, 41, 43, 45 extending upwardly from the respective ends thereof. The front side-rails on either side of the frame 33 are connected to a front cross-rail 47 and the rear side rails 41, 45 are similarly connected by a rear cross-rail 49. The rear side-rails 41, 45 are of a greater relative length than the front side-rails 39, 43 making the rear cross-rail 49 of greater relative height than the front cross-rail 47 with respect to the plane defined by the bottom rails 35, 37. Reinforcing bars 51, 53 are rigidly affixed between the top corners 55, 57 and intermediate point 59, 61 respectively, on the bottom rails 35, 37.

Figure 3:
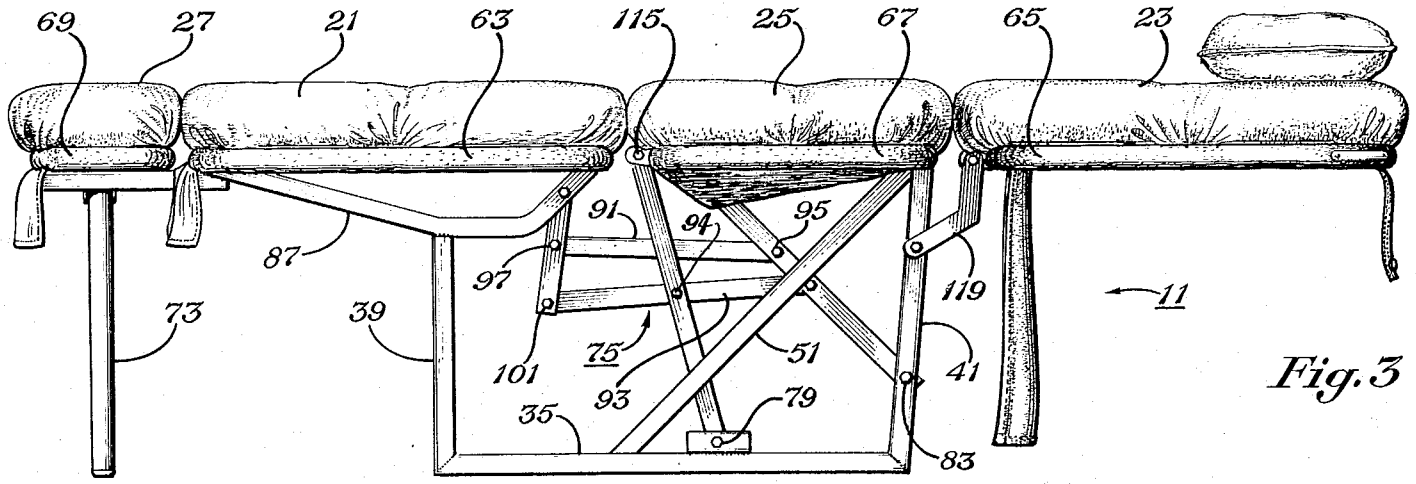
FIG. 3 is a side perspective view of the sofa bed of FIG. 1.
Figure 7:
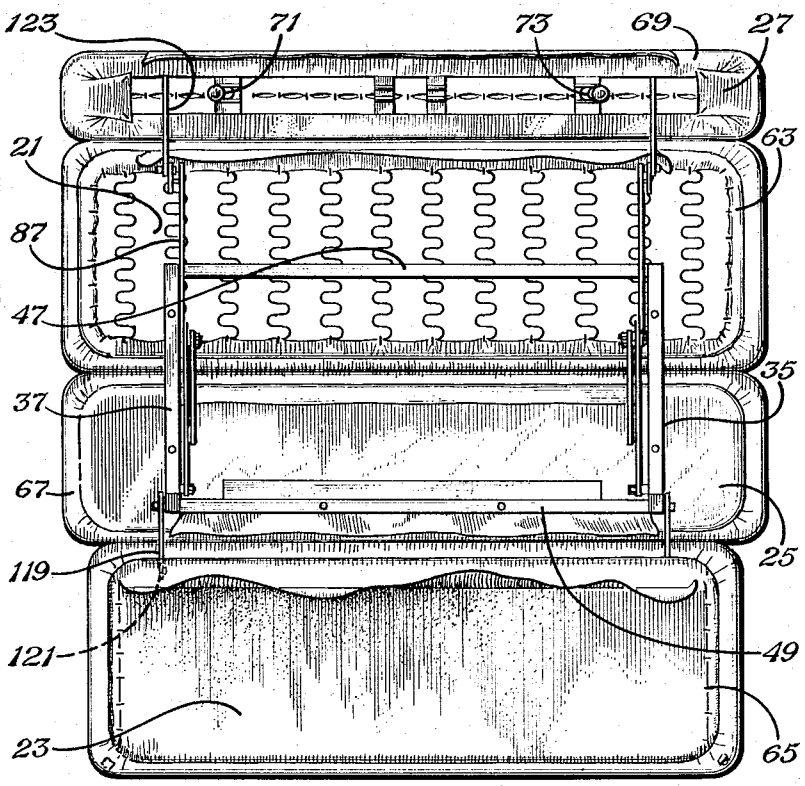
FIG. 7 is a bottom view of the bed of FIG. 1 in the folded down position.
Figure 6:
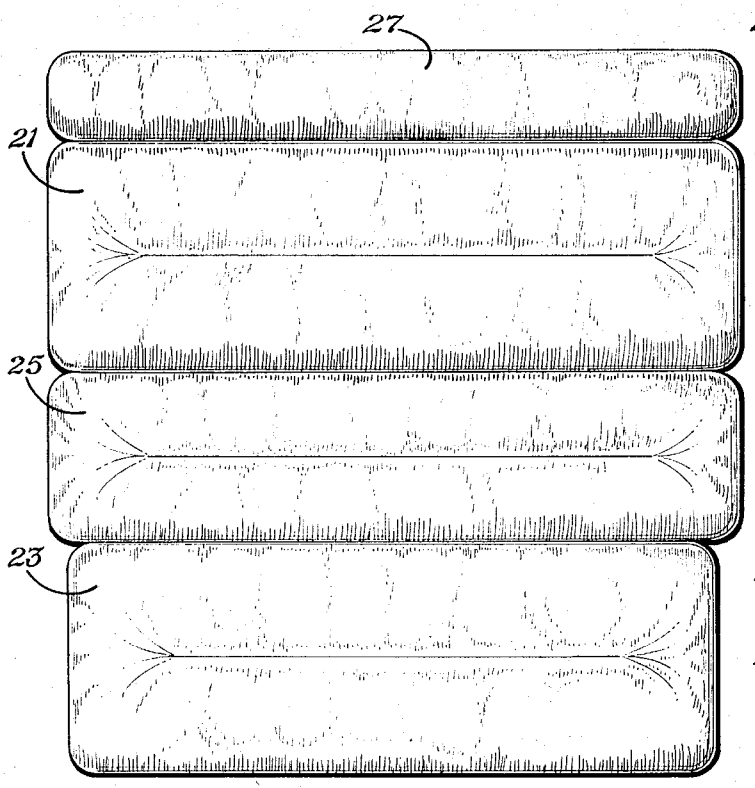
FIG. 6 is a top view of the bed of FIG. 1 in the folded down position.

As shown in FIG. 3, the cushions 21, 23, 25 are each supported on a separate cushion frame 63, 65, 67. The cushion frames 63, 65, 67 are, as shown in FIG. 7, generally rectangular shaped and formed from bent metal tubing. The folding foot section 27 includes a simliar cushion frame 69 and has a pair of folding legs 71, 73 (see FIG. 1).

As shown in FIG. 3, the sofa bed 11 also includes linkage means for pivotally mounting the cushions 21, 23, 25 on the rigid frame 33 whereby the intermediate cushion 25 is pivotable between an upright position, as shown in FIG. 5, and a folded down position, as shown in FIG. 3. The upright position of the intermediate cushion shown in FIG. 5 forms a seat back with respect to the front cushion 21 when in the upright position and, as shown in FIG. 3, forms a bed in the same horizontal plane with the front and rear cushions 21, 23 when in the folded down position. The three-section bed formed by the cushions 21, 23, 25 in the folded down position shown in FIG. 3 provides a bed of a comfortable size for one or more adults. In addition, the folding foot portion 27 is optionally included and increases the length of the bed.

As shown in FIG. 3, the seat cushions are pivotally mounted on the rigid frame 33 by means of an identical pair of link mechanisms, designated generally as 75 in FIG. 3. As can be seen in FIG. 7, the seat cushions 21, 23, 25 and foot portion 27 overhang the rigid frame 33. In order to better illustrate the operation of the link mechanism 75, FIG's. 4 and 5 show the cushions 21, 23, 25 in the folded down and upright positions with portions of the cushions and cushion frames broken away. The reinforcing bars 51 are also shown in dotted lines for ease of illustration.

As shown in FIG's. 4 and 5, each of the link mechanisms 75 includes a pivoting bar 77 which is mounted on the bottom rail 35, 37 at a pivot point 79. It should be understood that although only one side of the mechanism is shown in FIG's. 3, 4 and 5, that the opposite side of the frame is identical. The pivot point 79 is located on the bottom rail 35 slightly in the direction of the rear side-rail 41 from the mid-section of the bottom rail 35. A first scissor arm 81 is connected to the rear side-rail 41 at a pivot point 83 and a second scissor arm 85 is connected to the front cushion frame 63 by means of an elbow bar 87 at a pivot point 89. The elbow bar 87 is connected to opposite sides of the front cushion frame 63, as shown in FIG. 7.

The scissor arms 81, 85 are connected by top and bottom connecting bars 91, 93. The top connecting bar 91 is connected to scissor arm 81 at a pivot point 95 and to the scissor arm 85 at a pivot point 97. The bottom connecting bar 93 is connected to the scissor arm 81 at a pivot point 99 and to the scissor arm 85 at a pivot point 101. Bottom connecting bar 93 is also pivotally connected to pivoting bar 77 in the approximate mid-region thereof at a pivot point 94. The first scissor arm 81 is pivotally connected at the end thereof opposite the connection to the rear side rail 41 to the intermediate cushion frame. An intermediate link 103 (FIG. 5) connects at a pivot point 105 to the scissor arm 81 and at a pivot point 107 to a bent connecting bar 109 which passes between opposite sides of the intermediate cushion frame 67. The end 111 of bar 109 is rigidly affixed to the intermediate cushion frame 67 and the bent end 113 is attached at a pivot point 115 to one end of the pivoting bar 77.

As shown in FIG's. 4–7, the rear cushion 23 is pivotally connected to the rear side-rail 41 at a pivot point 117 by a connecting V-shaped link 119. Link 119 pivots about a pivot point 121 on the rear cushion frame 65.

The foot section 27 is mounted on an angle bracket 123 which is rigidly affixed to the cushion frame 69 at a weld point 125 at one end and which includes a protruding bolt 127 which rides in a slot 129 of a flange 131 which is rigidly affixed at a weld point 133 to the front cushion frame 63. In this way, the foot portion 27 is pivotable between a collapsed position as shown in FIG. 5 and an upright position as shown in FIG. 4.

The operation of the invention will now be described with reference to FIG's. 4 and 5. The normal starting position of the sofa bed combination of the invention will be with the intermediate cushion 25 in the upright position as shown in FIG. 5. The foot portion 27 will normally be in the collapsed position as shown in FIG. 5 and the rear cushion 23 can be pivoted to an upright position, as shown in FIG. 5, or can be folded back as shown in FIG. 1 to provide a storage area behind the seat back. The rear cushion 23 is held in the position shown in FIG. 1 by contacting the van sidewalls.

The sofa bed of FIG. 5 is moved to the folded down position by pulling the front cushion slightly upward and outward in a direction away from the rear side-rail 41. As the front cushion 21 begins to move outward, the intermediate cushion 25 begins to move clockwise in an arc about the pivot point 115, gradually moving to the folded down position shown in FIG. 4. The pivoting bar 77 and first scissor arm 81 move to the left with respect to the rear side-rail 41. As the scissor arms 81, 85 move with the cushions 21, 25 between the upright and folded down positions, the connecting bars 91, 93 are shifted so that the "scissor opening" 135 is at the opposite end of the connecting bars 91, 93 as shown in FIG. 4. As the intermediate cushion 25 is moving from the upright position shown in FIG. 5 to the folded down position shown in FIG. 4, the point of contact 137 of the elbow bar 87 with the front side-rail 39 moves toward the pivot point 89, as shown in FIG. 4.

The sofa bed combination of the invention has many desirable features and advantages. The device forms a rear seat for the van when the intermediate cushion is in the upright position. The device is then pivotable to a folded down position which forms a three-section bed of adequate size for one or more adults to sleep comfortably. The device can be moved between the upright and folded down positions with ease by one person. Since the three principle sections of the device are attached by the link mechanism to the rigid frame, there are no loose portions of the device to slide around in the rear of the van while the van is traveling on the highway. The device, when folded in the upright position, conserves space and occupies only about as much room as a traditional automotive van seat.

While the invention has been shown in only one of its forms, it is not thus limited but is susceptible to various changes and modifications without departing from the spirit thereof.

I claim:

1. A sofa bed combination adapted to be mounted in the interior of a van, comprising:

a front cushion, a rear cushion, and an intermediate cushion, the cushions being of the same approximate width;

a rigid frame, less than the width of said cushions;

linkage means for connecting and pivotally mounting said front and intermediate cushions on said rigid frame, whereby said intermediate cushion is pivotable between an upright position which forms a seat back with respect to said front cushion and a folded down position, said folded down position being in the same horizontal plane as said front cushion to form a bed, said rear cushion being pivotally mounted on said rigid frame independently of said front and intermediate cushions and being pivotable between an upright position to provide a storage area behind said sofa bed and a folded down position in the same horizontal plane as said front cushion; and said rigid frame being sized to fit within the interior of said van whereby said front and intermediate cushions form a rear seat for said van when said intermediate cushion is in said upright position and wherein said front, intermediate and rear cushions form a three-section bed when said intermediate and rear cushions are in said folded down position.

2. A sofa bed combination adapted to be mounted in the interior of a van, comprising:

a front cushion, a rear cushion, and an intermediate cushion, the cushions being of the same approximate width;

a rigid frame:

linkage means for connecting and pivotally mounting said front and intermediate cushions on said rigid frame, whereby said intermediate cushion is pivotable between an upright position which forms a seat back with respect to said front cushion and a folded down position, said folded down position being in the same horizontal plane as said front cushion to form a bed, said rear cushion being pivotally mounted on said rigid frame independently of said front and intermediate cushions and being pivotable between an upright position to provide a storage area behind said sofa bed and a folded down positioon in the same horizontal plane as said front cushion; and said rigid frame being sized to fit within the interior of said van whereby said front and intermediate cushions form a rear seat for said van when said intermediate cushion is in said upright position and wherein said front, intermediate and rear cushions form a three-section bed when said intermediate and rear cushions are in said folded down position, said rigid frame having a pair of spaced-apart bottom rails, each of said bottom rails having front and rear side-rails extending upwardly from the respective ends thereof, said front side-rails being connected by a front cross-rail and said rear side-rail being connected by a rear cross-rail.

3. A sofa bed combination adapted to be mounted in the interior of a van, comprising:

a front cushion, a rear cushion, and an intermediate cushion;

a rigid frame;

linkage means for pivotally mounting said cushions on said rigid frame, whereby said intermediate cushion is pivotable between an upright position which forms a seat back with respect to said front cushion and a folded down position, said folded down position being in the same horizontal plane as said front and rear cushions to form a bed; and said rigid frame being sized to fit within the interior of said van whereby said front and intermediate cushions form a rear seat for said van when said intermediate cushion is in said upright position and wherein said front, intermediate and rear cushions form a three-section bed when said intermediate cushion is in said folded down position, said rigid frame having a pair of spaced-apart bottom rails, each of said bottom rails having front and rear side-rails extending upwardly from the respective ends thereof, said front side-rails being connected to a front cross-rail and said rear side-rail being connected by a rear cross-rail; and wherein said front, intermediate and rear cushions are each supported on a separate cushion frame and wherein said spaced-apart bottom rails having matching link mechanisms mounted thereon for pivoting said cushions and wherein each of said link mechanisms includes a pivoting bar attached in the mid region of one of said bottom rails, a first scissor arm connected to a rear side-rail, a second scissor arm connected to the front cushion frame, and top and bottom connecting bars which piovotally connect said scissor arms.

4. A sofa bed combination adapted to be mounted in the interior of a van, comprising:

a front cushion, a rear cushion, and an intermediate cushion;

a rigid frame;

linkage means for pivotally mounting said cushions on said rigid frame, whereby said intermediate cushion is pivotable between an upright position which forms a seat back with respect to said front cushion and a folded down position, said folded down position being in the same horizontal plane as said front and rear cushions to form a bed; and said rigid frame being sized to fit within the interior of said van whereby said front and intermediate cushions form a rear seat for said van when said intermediate cushion is in said upright position and wherein said front, intermediate and rear cushions form a three-section bed when said intermediate cushion is in said folded down position, said rigid frame having a pair of spaced-apart bottom rails, each of said bottom rails having front and rear side-rails extending upwardly from the respective ends thereof, said front side-rails being connected by a front cross-rail and said rear side-rail being connected by a rear cross-rail; and wherein said front, intermediate and rear cushions are each supported on a separate cushion frame and wherein said spaced-apart bottom rails have matching link mechanisms mounted thereon for pivoting said cushions and wherein each of said link mechanisms includes a pivoting bar attached in the mid region of one of said bottom rails, a first scissor arm connected to a rear side-rail, a second scissor arm connected to the front cushion frame, and top and bottom connecting bars which pivotally connect said scissor arms, said first scissor arms being pivotally connected at the end opposite said connection to said rear side rail to said intermediate cushion frame.

5. A sofa bed combination adapted to be mounted in the interior of a van, comprising:

a front cushion, a rear cushion, and an intermediate cushion;

a rigid frame;

linkage means for pivotally mounting said cushions on said rigid frame, whereby said intermediate cushion is pivotable between an upright position which forms a seat back with respect to said front cushion and a folded down position, said folded down position being in the same horizontal plane as said front and rear cushions to form a bed; and said rigid frame being sized to fit within the interior of said van whereby said front and intermediate cushions form a rear seat for said van when said intermediate cushion is in said upright position and wherein said front, intermediate and rear cushions form a three-section bed when said intermediate cushion is in said folded down position, said rigid frame having a pair of spaced-apart bottom rails, each of said bottom rails having front and rear side-rails extending upwardly from the respective ends thereof, said front side-rails being connected by a front cross-rail and said rear side-rail being connected by a rear cross-rail; and wherein said front, intermediate and rear cushions are each supported on a separate cushion frame and wherein said spaced-apart bottom rails have matching link mechanisms mounted therein for pivoting said cushions and wherein each of said link mechanisms includes a pivoting bar attached to the mid region of one of said bottom rails, a first scissor arm connected to a rear side-rail, a second scissor arm connected to the front cushion frame, and top and bottom connecting bars which pivotally connect said scissor arms, said first scissor arms, said first scissor arms being pivotally connected at the end opposite said connection to said rear side rail to said intermediate cushion frame; and wherein a selected one of said connecting bars on each side of said frame is pivotally connected to the adjacent pivoting bar.

* * * * *